US005257070A

United States Patent [19]

Miller et al.

[11] Patent Number: 5,257,070

[45] Date of Patent: Oct. 26, 1993

[54] SELECTIVE CONTROL OF DISTRIBUTED DRIVES TO MAINTAIN INTERDOCUMENT GAP DURING JAM RECOVERY PURGE

[75] Inventors: Donald L. Miller, Penfield; Ronald P. Booth, Sr., Pittsford; Gary W. Roscoe, Fairport; Prashant K. Phadnis, Henrietta, all of N.Y.

[73] Assignee: Xerox Corporation, Stamford, Conn.

[21] Appl. No.: 941,621

[22] Filed: Sep. 8, 1992

[51] Int. Cl.[5] ..... G03G 21/00

[52] U.S. Cl. ..... 355/207; 271/301; 355/205; 355/208; 355/309; 355/321

[58] Field of Search ..... 355/204–208, 355/308–309, 313, 317, 321; 271/3, 301, 258, 259, 65

[56] References Cited

U.S. PATENT DOCUMENTS 4,231,567 11/1980 Ziehm ..... 271/259
4,627,711 12/1986 Schron ..... 355/208
4,786,041 11/1988 Acquaviva et al. ..... 271/3.1
4,878,428 11/1989 Watarai ..... 355/206 X
5,045,881 9/1991 Kinder et al. ..... 355/206
5,086,319 2/1992 Carolan ..... 355/317
5,142,340 8/1992 Farrell et al. ..... 355/283

*Primary Examiner*—A. T. Grimley
*Assistant Examiner*—Matthew S. Smith
*Attorney, Agent, or Firm*—Ronald F. Chapuran

[57] ABSTRACT

A method of purging copy sheets after a machine malfunction from a copy sheet path having a plurality of zones including the steps of determining the existence of copy sheets in process in any of the copy sheet path zones, selectively activating a plurality of independent copy sheet drives to maintain a predetermined interdocument space between any copy sheets in process and systematically purging the copy sheets from the zones of the paper path in a predetermined order based upon the particular disposition of the copy sheets in the sheet path zones.

13 Claims, 2 Drawing Sheets

SELECTIVE CONTROL OF DISTRIBUTED DRIVES TO MAINTAIN INTERDOCUMENT GAP DURING JAM RECOVERY PURGE

BACKGROUND OF THE INVENTION

The invention relates to jam recovery and, more particularly, to a technique for eliminating malfunctions during a jam recovery purge cycle.

In using reproduction machines, there are various types of system shut downs or malfunctions that can occur in the various system operating modes. Operator involvement in correcting for the malfunction can often be extensive particularly in machines with various accessories such as sorters, collators, finishers and document handlers. The problem of correcting the malfunction, maintaining the integrity of the run in process, and minimizing down time and operator involvement can be significant.

Jam recovery and associated job recovery in many present copiers often requires the removal of documents and copy sheets stopped in several places in the machine even if the jam occurred in only one location to only one document. Jam recovery also often requires the manual restacking of the manually reordered document set back in the document handler tray, as well as the removal and throwing away of some or all of copies in process in the machine. This can be a time consuming and inefficient operation.

It is known for machines to provide a "cluster jam" of copy sheets by continuing to run sheet feeders after a jam so as to move unjammed sheets downstream of a jam point to an output tray, and to move other sheets to other suitable jam clearance cites, rather than leaving all the sheets in the path at their original positions when a jam occurs. Art of particular interest thereto is Xerox Corporation U.S. Pat. No. 4,231,567.

It is also disclosed in Xerox U.S. Pat. No. 5,045,881, for the operator to direct printed copy sheets to various different copy sheet output compiling stations, such as a stacking tray or a finisher compiler. Those copy sheets desired to be purged rather than provided as finished copies are directed to a particular designated station for operator removal and disposal. Preferably this designated purge station is a readily operator accessible tray.

In addition, Xerox U.S. Pat. No. 4,786,041, discloses an improved jam clearance and job recovery system for a recirculating document handler (RDH) for determining whether a jammed document is present in a first, second, or third document path jam zone, each jam zone corresponding to three distributed drive zones. The system automatically provides a preliminary job recovery operation before the RDH is fully stopped, by correspondingly operating the document feeding zones to feed unjammed documents in the third jam zone to a stacking tray, or to feed unjammed documents in the first jam zone to the platen, so that documents are directed to be operator removed from only one zone.

One difficulty not considered in these prior art devices is the potential for malfunctions and jams during a purge cycle or during the time that in process copy sheets are being manipulated for eventual disposal or use in the recovery procedure. This problem becomes more pronounced as the complexity, volume, and speed of operation increases in modern day machines. It is also not unusual in these modern day machines for copies in process to bunch up or deviate from normal process relationships due to inertia upon cycling down of the machine in response to machine malfunctions. The incorrect spacing of copy sheets in process often leads to further jams or malfunctions as the machine attempts to recover from the initial malfunction.

It would be desirable, therefore, to compensate for the deviant or irregular spacing relationships of copy sheets in process in response to machine recovery techniques after a machine jam or malfunction.

It is an object, therefore, of the present invention to be able to avoid further machine malfunctions during the recovery and cycle up period of a machine after a jam. Another object of the present invention is to maintain a suitable document spacing between copy sheets in process during a machine recovery operation. Another object of the present invention is to selectively engage independent copy sheet drives during job recovery to systematically purge unwanted copy sheets. Other advantages of the present invention will become apparent as the following description proceeds, and the features characterizing the invention will be pointed out with particularity in the claims annexed to and forming a part of this specification.

SUMMARY OF THE INVENTION

The method of purging copy sheets from a copy sheet path having a plurality of zones after a machine malfunction including the steps of determining the existence of copy sheets in process in any of the copy sheet path zones, selectively activating a plurality of independent copy sheet drives to maintain a predetermined interdocument space between any copy sheets in process, and systematically purging the copy sheets from the zones of the paper path in a predetermined order based upon the particular disposition of the copy sheets in the copy sheet path zones.

For a better understanding of the present invention, reference may be had to the accompanying drawings wherein the same reference numerals have been applied to like parts and wherein:

DETAILED DESCRIPTION OF THE DRAWINGS

Figure 1:
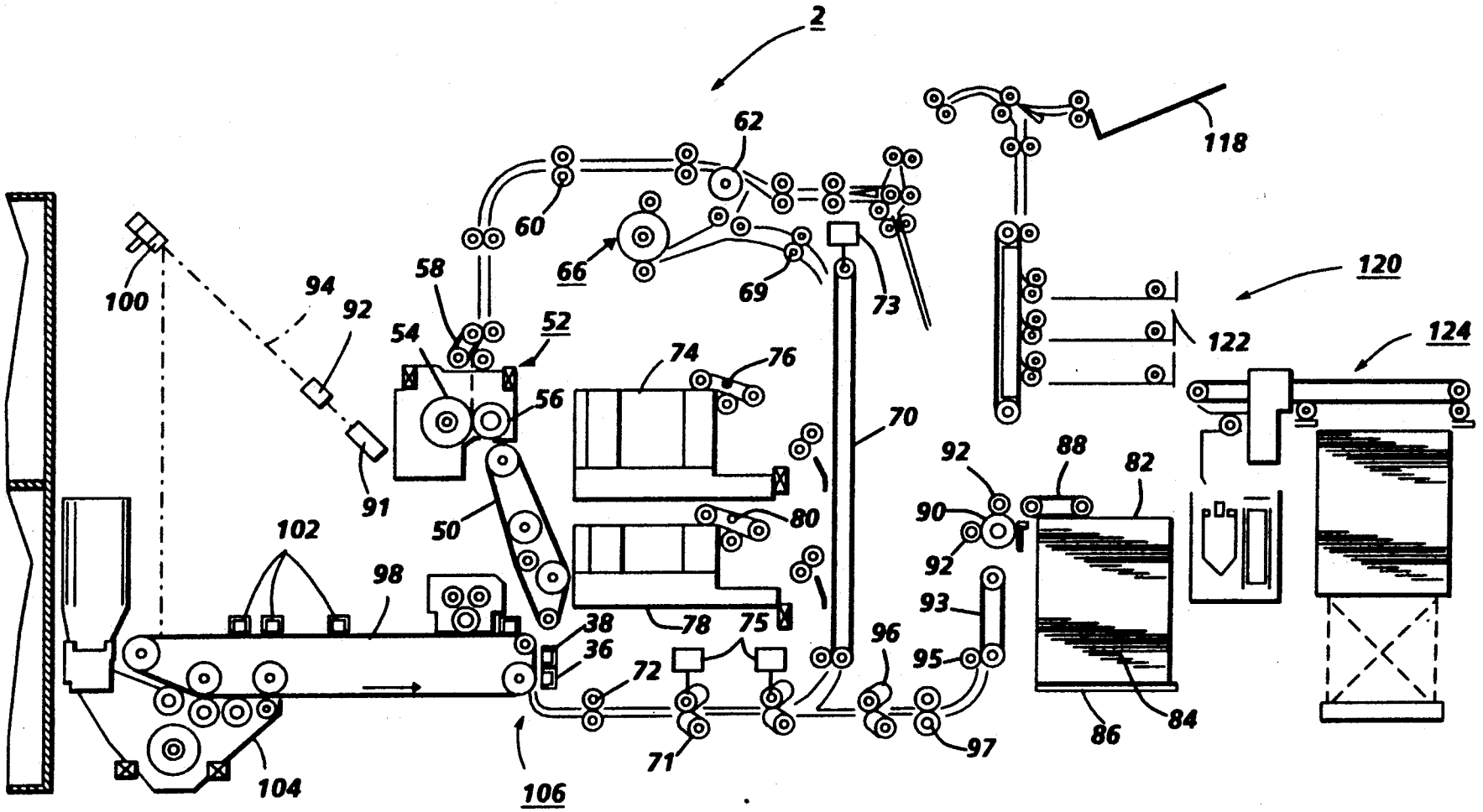
Figure 2:
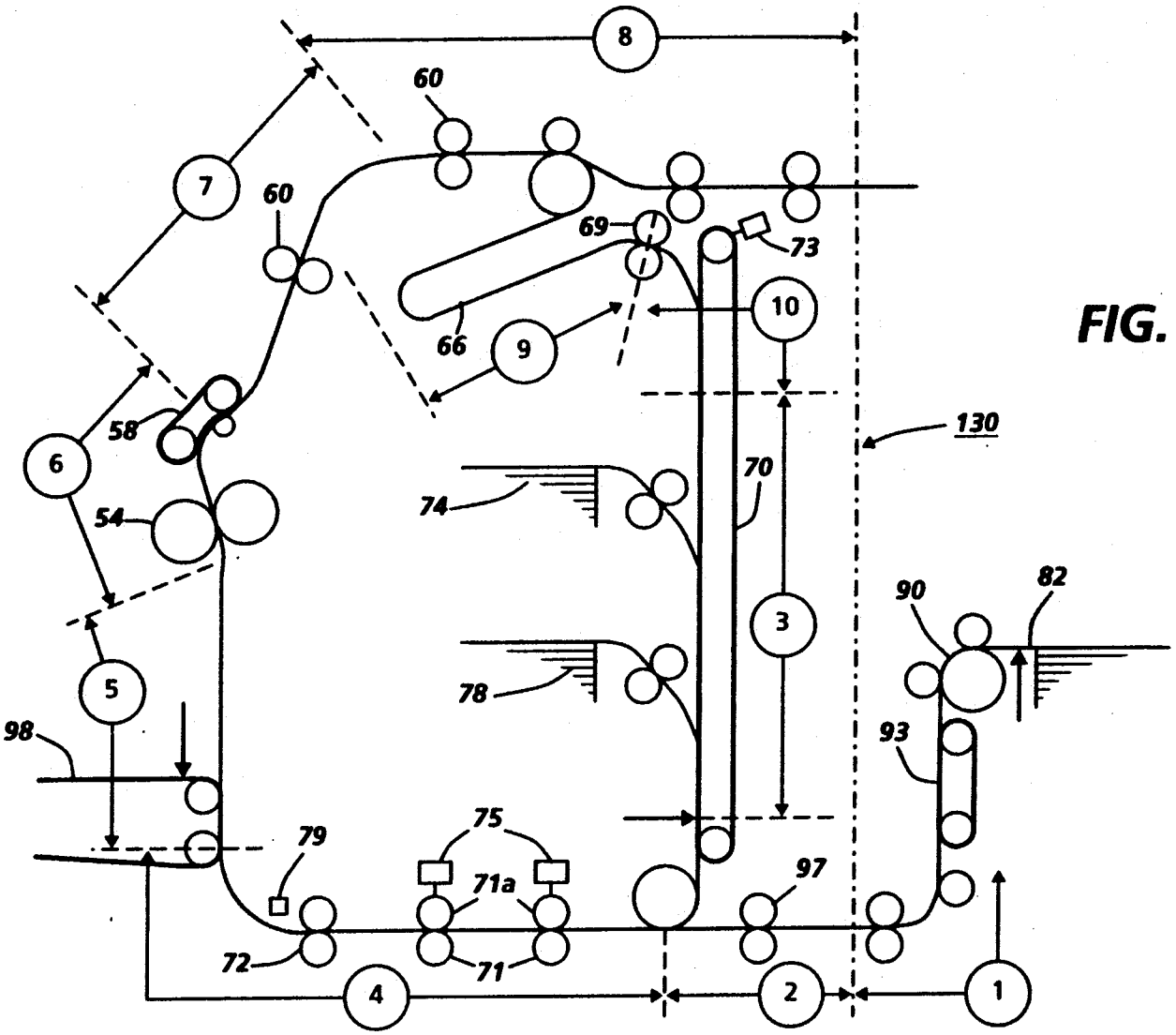

FIG. 1 is a plan view illustrating the principal mechanical components of a typical printing system incorporating the present invention; and FIG. 2 is an expanded view of the copy sheet path of FIG. 1 in accordance with the present invention.

DETAILED DESCRIPTION OF THE PREFERRED EMBODIMENT

Referring to FIG. 1, there is shown an exemplary laser based-printing system 2 for processing print jobs in accordance with the teachings of the present invention. Printing system 2 for purposes of explanation is divided into a controller section and a printer section. While a specific printing system is shown and described, the present invention may be used with other types of printing systems such as ink jet, ionographic, etc.

The printer section comprises a laser type printer and for purposes of explanation is separated into a Raster Output Scanner (ROS) section, Print Module Section, Paper Supply section, and Finisher. The ROS has a laser 91, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of the Print Module by the mirrored facets of a rotating polygon 100 to expose two image lines on photoreceptor 98 with each scan and create the latent electrostatic images represented by the image signal input to modulator 92. Photoreceptor 98 is uniformly charged by corotrons 102 at a charging station preparatory to exposure by imaging beams 94. The latent electrostatic images are developed by developer 104 and transferred at transfer station 106 to print media delivered by the Paper Supply section. Print media, as will appear, may comprise any of a variety of sheet sizes, types, and colors. For transfer, the print media or copy sheet is brought forward in timed registration with the developed image on photoreceptor 98 from either a main paper tray high capacity feeder 82 or from auxiliary or secondary paper trays 74 or 78.

A copy sheet is provided via de-skew rollers 71 and copy sheet feed roller 72. At the transfer station 106, the photoconductive belt 98 is exposed to a pretransfer light from a lamp (not shown) to reduce the attraction between photoconductive belt and the toner powder image. Next, a corona generating device 36 charges the copy sheet to the proper magnitude and polarity so that the copy sheet is tacked to photoconductive belt and the toner powder image attracted from the photoconductive belt to the copy sheet. After transfer, corona generator 38 charges the copy sheet to the opposite polarity to detack the copy sheet from belt.

Following transfer, a conveyor 50 advances the copy sheet bearing the transferred image to the fusing station where a fuser assembly indicated generally by the reference numeral 52 permanently affixes the toner powder image to the copy sheet. Preferably, fuser assembly 52 includes a heated fuser roller 54 and a pressure roller 56 with the powder image on the copy sheet contacting fuser roller 54.

After fusing, the copy sheets are fed through a decurler 58 to remove any curl. Forwarding rollers 60 then advance the sheet via duplex turn roll 62 to a gate which guides the sheet to output tray 118, finishing station 120 or to duplex inverter 66. The duplex inverter 66 provides a temporary wait station for each sheet that has been printed on one side and on which an image will be subsequently printed on the opposite side. Each sheet is held in the duplex inverter 66 face down until feed time occurs.

To complete duplex copying, the simplex sheet in the inverter 66 is fed back to the transfer station 106 via conveyor 70, de-skew rollers 71 and paper feed rollers 72 for transfer of the second toner powder image to the opposed sides of the copy sheets. The duplex sheet is then fed through the same path as the simplex sheet to be advanced to the finishing station which includes a stitcher and a thermal binder.

Copy sheets are supplied from the secondary tray 74 by sheet feeder 76 or from secondary tray 78 by sheet feeder 80. Sheet feeders 76, 80 are friction retard feeders utilizing a feed belt and take-away rolls to advance successive copy sheets to transport 70 which advances the sheets to rolls 72 and then to the transfer station.

A high capacity feeder 82 is the primary source of copy sheets. Tray 84 of feeder 82 is supported on an elevator 86 for up and down movement and has a vacuum feed belt 88 to feed successive uppermost sheets from the stack of sheets in tray 84 to a take away drive roll 90 and idler rolls 92. Rolls 90, 92 guide the sheet onto transport 93 which in cooperation with idler roll 95, de-skew rollers 96 and paper feed rollers 97 move the sheet to the transfer station via de-skew rollers 71 and feed rollers 72.

With reference to FIG. 2, in accordance with the present invention, an enlarged sketch of the copy sheet path is illustrated with ten predetermined copy sheet paths zones. The zones are identified by the circled numbers, and are defined by the arrows extending from the circled numbers between dotted lines. The dashed line 130 illustrates the interface between the copy handling module and the finisher station 120. Zones 1 and 2 illustrate the copy sheet path from the high capacity feeder 82 to de-skew rollers 71, zone 3 illustrates the copy sheet path along conveyor or transport 70, zone 4 illustrates the copy sheet path from the de-skew rollers 71 to the transfer station, 106. Zone 5 illustrates the copy sheet path between the transfer station and the fuser 52, zone 6 illustrates the copy sheet path from the fuser to decurler 58, zone 7 illustrates the copy sheet path between the decurler 58 and the rollers 60, zone 8 illustrates the copy sheet path from the rollers 60 to the finishing station, zone 9 illustrates the copy sheet path from the duplex invertor 66 to the duplex feed rolls, and zone 10 illustrates the copy sheet path between the duplex feed rolls 69 and the top of the conveyor 70.

It should be noted that the partitions of the copy sheet path into ten zones is arbitrary. However, in accordance with the present invention, certain portions of the copy sheet path are independently driven and are adapted to be selectively turned on or off through the operation of motor, solenoids and clutch mechanisms. For example, a suitable clutch 73 mechanically connected to the transport or conveyor 70 controls the movement of the conveyor 70 and suitable solenoids 75 operate to selectively engage and disengage the de-skew rollers 71.

In one embodiment of the present invention, zones 5, 6, 7 and 8 are driven by the main drive of the machine, and therefore with the main drive in operation, copy sheets are driven from the transfer station 106 at the photoreceptor 98 to the input to the finishing station 102. Zones 1 and 2 are driven by the high capacity feeder drive 90, 93 to convey copy sheets from the high capacity feeder to engagement with the de-skew rollers 71 and copy sheets in zone 3 are driven by the transport 70 suitably interconnected to the main drive through the transport clutch 73. Copy sheets in zone 4 are independently driven by a registration servo motor suitably driving the registration rolls 72 as well as by the operation of a cross roll motor driving de-skew rollers 71 suitably engaged to oppositely disposed idler rolls 71*a* by the activation and inactivation of solenoid 75. Finally, copy sheets in the duplex tray are driven by duplex drive rolls 69 into engagement with the transport 70.

In operation, upon the detection of a jam in the machine requiring sheet removal and or reordering, the machine will cycle down. Because of the distributed drive architecture, and the independent and non-uniform operation of the various drives and inertia of components, upon the cycling down, normal spacing of copy sheets in process within the machine often will be altered. Thus, for example sheets in process sometimes will be overlapped and bunched up on the registration and vertical transports, as illustrated by zones 3 and 4. Sheets that are not purged manually will be purged automatically by the machine upon the initiation of a cycle up recovery procedure. However, these overlapped or non-uniformly spaced sheets, if not suitably separated during the recovery, will often cause additional jams as the sheets are conveyed along the paper path to a purge destination or tray.

In accordance with the present invention, therefore, at the start of a cycle up recovery, the different copy sheet drives are selectively activated to maintain suitable spacing between copy sheets to be purged. Thus, the sheets in process are purged in a predetermined order based upon the copy sheet path zones. In general, initially all copy sheets in process in zones 5, 6, 7 and 8 are immediately purged to an output station or tray while the other copy sheet drives remain inactive. In particular, if a sheet in process is at the registration rolls 72, the registration rolls are not activated to insure that the sheet at the registration roll is held back to be at the proper spacing with any sheet at the transfer station. After the movement of any sheets at the transfer station 106 to a suitable spacing and the movement of sheets throughout zones 5, 6, 7 and 8, the registration servo driving rollers 72 and the cross roll or de-skew rollers 71 are operated to step copy sheets in process in zones 3 and 4 through the de-skew rollers and registration rollers to zones 5, 6, 7 and 8 with a suitable document gap. Upon clearing zones 3 as well as copy sheets in the duplex tray and zones 9 and 10 through the process, the procedure then switches to any copy sheets in process in zones 1 or 2 being fed by the high capacity feeder. These copy sheets in process are then also stepped through zones 4, 5, 6, 7 and 8 to be purged to an output station.

Again, with reference to FIG. 2, at the start of cycle up recovery, the main drive is turned on to purge out sheets left in the paper path down stream (zones 5, 6, 7 and 8) of the registration servo rollers 72. This forces a gap between a sheet in the transfer area and any sheet held in the registration servo rollers 72. After the gap has been created, the registration servo motor is turned on. This will start any sheet in the registration servo rollers 72 moving through the paper path. In turn, this naturally separates any sheet in the registration servo rollers 72 from any other sheets on the registration transport (i.e. in zone 4).

Next, the remaining sheets on the registration transport or in zone 4 must be driven out one at a time. This is done by activating solenoid 75 to disengage rolls 71*a* from contact with rollers 71 to hold sheets on the vertical transport 70 until the next sheet is detected at the registration servo sensor 79, at which time, the rollers 71 are turned back off. At this point the sheet that arrived at the registration servo sensor 79 is in the servo rollers 72 and will continue to be driven through zones 5, 6, 7, 8 out of the machine. But because the rollers 71 were turned off, any sheets remaining on the registration transport are held. This serves to force a gap between the first sheet on the registration transport and any others on the transport. After 1000 machine clock counts, the rollers 71 are turned back on until the next sheet on the registration transport is brought up to the servo rollers 72. Again, this sheet is allowed to continue on while the other sheets are stopped. This cycle repeats until all sheets are cleared off of the registration transport.

Next, the vertical transport 70 is cleared in a similar manner. The solenoid 75 is turned off and the vertical transport clutch 73 and the rollers 71 are turned on. As soon as a sheet arrives at the registration servo sensor 79, the vertical transport clutch 73 and the rollers 71 are turned off to hold sheets on the registration transport, but the sheet at the registration servo sensor 75 continues on. After 1000 machine clock counts, the vertical transport clutch and the rollers 71 are turned on again and the next sheet is brought up to registration servo sensor 79. This continues until all of the sheets are cleared off of the vertical registration transport 70. Now the high capacity feeder 82 is directed to clear to transport in a similar manner.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. In an image processing apparatus for producing images on copy sheets including a copy sheet path having a plurality of zones, a plurality of copy sheet drives, and a controller for directing the image processing apparatus, the method of recovery from a copy sheet jam comprising the steps of:

detecting a machine malfunction, responding to the malfunction to inhibit operation of the machine, activating a first copy sheet drive to purge a first copy sheet from a first zone of the copy sheet path, selectively activating a second copy sheet drive to purge a second copy sheet from a second zone of the paper path, and operating a third copy sheet drive to purge a third copy sheet from a third zone of the paper path, the first, second, and third drives being independently driven.

2. The method of claim 1 wherein the first copy sheet drive is the main processing apparatus drive and the first zone is the copy sheet path from a transfer station to an output tray.

3. The method of claim 1 wherein the second copy sheet drive is a sheet registration servo and the second zone is the copy sheet path from the sheet registration servo to the output of a duplex tray.

4. The method of claim 1 wherein the third copy sheet drive is a high capacity sheet feed drive and the second zone is the copy sheet path at the output of the high capacity sheet feed.

5. In an image processing apparatus for producing images on copy sheets including a copy sheet path having a plurality of zones, a plurality of copy sheet drives, and a controller for directing the image processing apparatus, the method of purging copy sheets from the copy sheet path after a machine malfunction comprising the steps of:

detecting a machine malfunction, responding to the machine malfunction to inhibit operation of the machine, determining the existence of copy sheets in process in any of said plurality of zones, and selectively activating the plurality of copy sheet drives to systematically purge copy sheets from the zones of the copy sheet path including the step of sequentially starting and stopping the plurality of copy sheet drives.

6. The method of claim 5 wherein the step of selectively activating the plurality of copy sheet drives to systematically purge copy sheets from the zones of the copy sheet path includes the step of maintaining a predetermined interdocument space between said copy sheets in process.

7. In an image processing apparatus for producing images on copy sheets including a copy sheet path having a plurality of zones, a plurality of copy sheet drives, and a controller for directing the image processing apparatus, the method of purging copy sheets from the copy sheet path after a machine malfunction comprising the steps of:

responding to the machine malfunction to inhibit operation of the machine, determining the existence of copy sheets in process in any of said plurality of zones, and selectively activating the plurality of copy sheet drives to maintain a predetermined interdocument space between said copy sheets in process, and systematically purging the copy sheets from the zones of the copy sheet path.

8. The method of claim 7 wherein the step of systematically purging the copy sheets from the zones of the copy sheet path includes the step of progressively purging the plurality of zones in a predetermined order.

9. The method of claim 8 wherein the step of progressively purging the plurality of zones in a predetermined order includes the steps of first clearing the copy sheet path between a transfer station and an output tray.

10. The method of claim 8 including the step of clearing the copy sheet path between a sheet registration drive and the output of a copy sheet tray.

11. An image processing apparatus for producing images on copy sheets including a copy sheet having a plurality of zones, a plurality of copy sheet drives, a controller for directing the image processing apparatus, and means for purging copy sheets from the copy sheet path after a machine malfunction comprising means for determining the existence of copy sheets in process in any of said plurality of zones, means for maintaining a predetermined interdocument space between said copy sheets in process, and means for selectively activating the plurality of copy sheet drives to systematically purge copy sheets from the zones of the copy sheet path.

12. The apparatus of claim 11 including means for sequentially starting and stopping the plurality of copy sheet drives.

13. An image processing apparatus for producing images on copy sheets including a copy sheet path having a plurality of zones, a plurality of copy sheet drives, a controller for directing the image processing apparatus, and means for purging copy sheets from the copy sheet path after a machine malfunction comprising means for determining the existence of copy sheets in process in any of said plurality of zones, means for maintaining a predetermined interdocument space between said copy sheets in process, and means for selectively activating the plurality of copy sheet drives to systematically purge copy sheets from the zones of the copy sheet path including means for sequentially starting and stopping the plurality of copy sheet drives.

* * * * *